United States Patent [19]

Guidry et al.

[11] Patent Number: 4,681,163

[45] Date of Patent: Jul. 21, 1987

[54] SAND CONTROL SYSTEM

[75] Inventors: John P. Guidry, Sugar Land; Lee Roy C. Gavranovic, Guy, both of Tex.

[73] Assignee: Well Improvement Specialists, Inc., Houston, Tex.

[21] Appl. No.: 797,109

[22] Filed: Nov. 12, 1985

[51] Int. Cl.[4] ..... E21B 43/04; E21B 43/10

[52] U.S. Cl. ..... 166/278; 166/51; 166/227; 175/314

[58] Field of Search ..... 166/278, 276, 51, 296, 166/157, 227, 236; 175/314

[56] References Cited

U.S. PATENT DOCUMENTS

| | | | |
|---|---|---|---|
| 50,976 | 11/1865 | St. John | 175/314 |
| 58,953 | 10/1866 | Osgood | 175/314 X |
| 963,549 | 7/1910 | Harmon | 175/314 X |
| 1,974,664 | 9/1934 | Patten | 175/314 |
| 2,216,037 | 9/1940 | Layne | 166/278 |
| 2,321,318 | 6/1943 | Reistle, Jr. | 175/314 |
| 2,356,769 | 8/1944 | Layne | 166/278 |
| 2,513,944 | 7/1950 | Kessler | 166/278 |
| 3,362,475 | 1/1968 | Huitt et al. | 166/278 |
| 3,587,740 | 6/1971 | Gerwick et al. | 166/278 |

OTHER PUBLICATIONS

N-Situ Technology, Section 3, Baker Sand Control, '84-'85 Catalog, pp. 23-50, 55-56.

Introduction to Oil Well Service and Workover, U. T. Austin, 1971, p. 23.

Workover Well Control, Adams, pp. 4-11.

Halliburton Services Sales and Service Catalog, 1970-1971, pp. 130-136.

Casing Hardware and Oilfield Service Tools, Dowell, '82-'83 Composite Catalog, pp. 2520-2523.

*Primary Examiner*—Stephen J. Novosad

*Attorney, Agent, or Firm*—Vaden, Eickenroht, Thompson & Boulware

[57] ABSTRACT

A Wellbore sand control and filtration system, method, and apparatus for controlling formation sands and for preventing the influx of formation sands into the wellbore, into the production string, and into the produced fluids, the system including introducing smooth particles into the wellbore with limited or no pumping either of particles or of fluids with the particles, introducing the production string into the wellbore with the bottom of the string being introduced into the accumulation of smooth particles, the bottom of the string having connected thereto a tool permitting flow of formation fluids into the production string, the tool moving into the accumulation of particles forcing particles into the perforation tunnels extending from the annulus through the casing and cement into the formation. The system, method, and apparatus may also be used in an open uncased uncemented hole. A tool is provided for facilitating the movement of the string through the particles.

6 Claims, 22 Drawing Figures

CASED HOLE

Washing perforations to remove sand for space to place gravel

Gravel being squeezed through perforations

Cavity filled and screen being washed through gravel

Gravel and screen in place; wash pipe removed and well producing

CASED HOLE

OPEN HOLE

CASED HOLE CASED HOLE CASED HOLE

Open Hole Open Hole Open Hole

SAND CONTROL SYSTEM

BACKGROUND OF THE INVENTION

1. Field of the Invention

This invention relates to methods and apparatuses for the control of sand or formation particles in a wellbore.

2. Description of the Prior Art

For a hundred years attempts have been made to develop a method to keep sand out of a well and out of the fluids produced from a well. In California and the Gulf Coast of Louisiana and Texas sand problems are common. Control of sand production is a necessity. Uncontrolled sand infiltration is the primary cause for a major percentage of repairs necessary to maintain or improve production from wells. Formation sand causes tubing and perforations to plug. The sand also erodes and damages wellhead and production equipment. Sand movement occurs in almost all geologic formations including the shallow formations of the Tertiary age and in depths above 12,000 feet.

A variety of theories have been proposed to explain sand problems, including (a) higher flow rates and higher fluid viscosity increase the drag forces of flowing fluid; (b) production due to the dissolution of cementing materials causes a reduction in formation "strength" or a reduction in capillary forces with increasing water saturation, and (c) increased saturation causes reduced relative permeability to oil, thereby increasing pressure drawdown for a given production rate.

The various conventional sand control methods require the pumping of fluids to the bottom of the hole. These fluids and their components can damage the formation. The primary cause for formation damage is contact of the formation with a foreign fluid. This fluid could be a drilling mud, completion or workover fluid, or the reservoir fluid if its basic characteristics are altered. The damage itself results from the solids content of the foreign fluid or a chemical reaction between fluid and some component of the reservoir.

Solids plugging of the producing formation is common. Solids could include the solids employed with various conventional sand control systems. Small solids can cause severe plugging since they can be conveyed a considerable distance into the formation.

Diagnosis and remedial procedures are difficult. Diagnosis procedures include injection or productivity tests to determine the "skin effect," production log surveys defining intervals not contributing to the total flow, or comparison to comparable intervals in offset wells. Remedial measures include acidizing to remove swollen clays and oil-treating chemicals to break emulsions or reverse previous wettability changes.

Conventional sand control techniques fall into two categories: gravel packing and plasticizing. The two major types of gravel packing are conventional gravel packing and washdown gravel packing.

In conventional gravel packing a working string is introduced into the wellbore with a gravel pack screen at the bottom of the string. A shorter screen called a "tattletale" is placed above the gravel pack screen. The chosen gravel pack sand is pumped down the working string to surround the screen and pack the annulus between string and wellbore in the area of the perforations which extend into the producing formation. Once the packing has reached a level above the tattletale, pumping is stopped. Then prior to commencing production, the working string must be removed from the wellbore and a production string must be inserted. In a typical operation fluid is pumped at 2 to 4 barrels per minute and the fluid is composed of about half a pound of packing sand for each gallon of pumping fluid (usually water). Typically with this type of operation it will take about twenty-four hours to pack 100 feet of casing at a depth of 5,000 feet.

Conventional gravel packing has serious disadvantages. Excessive amounts of water are lost into the formation causing further damage and inhibiting production. Unwanted particles from the packing fluid enter the formation causing further damage and production inhibition. Water pumped past the perforation openings creates currents and vortices which result in the unwanted intermixing of formation particles and packing sand.

In wash down gravel packing the wellbore is filled with a desired amount of gravel pack sand, usually at least to a level above the perforations. The tubing string used to pump the packing is removed and a production string having a gravel pack screen at the bottom and a wash pipe therein is inserted into the packing. Water flowing down the wash pipe washes the gravel pack sand away to permit the screen and string to descend to a desired depth in the packing. This is necessary because the gravel pack sand, due to its high coefficient of friction, presents a relatively "hard" surface to the screen. The wash pipe must be removed prior to production. The disadvantages of this method are similar to those of conventional gravel packing.

In plasticizing or "high viscosity" gravel packing, special fluids are used which are relatively thick containing gelling agents or polymers with the gravel packing particles. A typical fluid will have 15 pounds of material per gallon of water. A string with a gravel pack screen is placed adjacent the producing formation. The high viscosity fluid is pumped into the annulus. Often a technique called "squeezing" is used in which pressure is applied to the emplaced packing in an effort to force packing into the perforations in the casing and cement. There are serious problems with this method. Once the packing operation is completed the gelling agent or polymer should be removed prior to production. Such removal is a tedious operation requiring the introduction of break-out or degradation elements to contact the polymer or gelling agent to release it and reduce its viscosity so it can be pumped out of the wellbore. Also the thickness of the material can cause uneven, nonhomogeneous packing with unwanted "bridging" occurring in the packing which prevents homogeneous packing below the bridge.

An unwanted result of adding plasticizing agents directly to the interstitial sand grains may be a notable reduction in permeability. In addition, proper mixing of the resins for the exact wellbore conditions may be difficult. The primary problem, however, is to attain uniform coverage of each perforation without fluid fingering into permeability stratifications.

The particular gravel pack sand used can remain in the wellbore during production and act as a filter to provide clean production fluids for introduction into the production string.

In accordance with §1.56 of 37 C.F.R. applicants are aware of the following prior art, copies of which are submitted herewith:

1. N-SITU TECHNOLOGY, Section 3, Baker Sand Control, 1984–1985 Catalog, pp. 23–50, 55–56.
2. Introduction to Oil Well Service and Workover, published by The University of Texas, p. 23, 1971.
3. Workover Well Control, by Adams, pp. 4–11.
4. Halliburton Services Sales and Service Catalog, 1970–1971, pp. 130–136.
5. Casing Hardware and Oilfield Service Tools, Dowell, 1982–1983 Composite Catalog, pp. 2520–2523.

SUMMARY OF THE INVENTION

The present invention is directed to a system, method, and apparatus for controlling sands and particles from producing formations and to a better filtration system for filtering production fluids. In accordance with the present invention no working string is required as is necessary with the conventional packing systems; rather a predetermined amount of smooth-surfaced particles, preferably spherical particles, is introduced into the wellbore, preferably in an amount sufficient to rise to a level above the casing perforations to ensure a good pack. The smooth-surfaced particles can be poured in or slowly pumped in. Particles which are generally smooth over all their surface and in the size range of about 5 millimeters to about 250 micrometers (4 to 60 U.S. MESH) are suitable. The size particle used and the combination of particles of various sizes will depend, inter alia, on the size of the particles of the formation sands. A production string with a gravel pack screen is then introduced into the wellbore to contact the smooth-surfaced particles and enter into them. As the screen moves into the particles, omni-directional forces are transmitted through the particle mass causing the particles to move upwardly in the annulus as they are displaced by the string and also causing particles to be forced into the perforations and beyond into the formation. If necessary a rig pump can be used for short bursts at a low flow rate to assist in the introduction of the screen and string into the particle mass. Fluid can be pumped through a typical one-inch wash pipe within the string. A jet-shoe below the screen can assist in the operation.

Also according to the present invention a new tool is provided to assist in the introduction of the string and screen into the particle mass. A tool is provided for swivelled mounting at the bottom of the string or below the screen, the tool having auger or screw members for facilitating in the upward and outward motion of the particles and the corresponding downward motion of the string with its screen. The tool may be pointed.

It is therefore an object of the present invention to provide a new and efficient sand control system, method, and apparatus.

Another object of the present invention is the provision of a sand control system and method which eliminates the need for use of a working string to introduce packing material into a wellbore.

Yet another object of the present invention is the provision of a system and method which can be accomplished in a relatively short time.

A further object of the present invention is the provision of a sand control system and method which require no or little pumping and no or little use of fluids.

An additional object of the present invention is the provision of a sand control system and method which provides a precise and accurate filtration medium for filtering fluids to be produced from a formation.

Another object of the present invention is the provision of a sand control system and method which can be employed without a wash pipe interiorly of the production string or which will only require minimal use of a wash pipe.

Yet another object of the present invention is the provision of a sand control system and method utilizing smooth-surfaced particles as the packing material and as the filtration medium.

A further object of the present invention is the provision of such a sand control system and method resulting in the introduction of the smooth-surfaced particles into the production perforations which extend through the casing and cement into the formation.

A particular object of the invention is the provision of such a system and method in which the smooth-surfaced particles are spherical.

Another particular object of the present invention is the provision of such a system and method in which the particles are glass beads.

Yet another object of the present invention is the provision of a sand control system and method in which an amount of smooth-surfaced particles is introduced into a cased and cemented wellbore adjacent production perforations which extend through the casing and cement into the formation, a production string then being introduced into the particles.

A further object of the present invention is the provision of such a system in which the introduction of the string forces particles into the perforations.

Another object of the present invention is the provision of an apparatus for facilitating the introduction of the string into the particles, the apparatus having a pointed portion for connection to the bottom of the string and auger members for easing the string's introduction into the particles.

A particular object is the provision of such an apparatus which is rotatably connected to the bottom of the string.

Yet another object of the present invention is the provision of sand control methods, systems, and apparatuses for introduction of an amount of smooth-surfaced particles into an open uncased, uncemented hole; the particles to serve as packing or filter medium or both, with the subsequent introduction of a tubular string into the particles.

To one of skill in this art who has the benefit of this invention's teachings, other and further objects, advantages, and features will be clear from the following description of the presently preferred embodiments of the invention, given for the purpose of disclosure, when taken in conjunction with the accompanying drawings.

FIG. *6a* is a cross-sectional view of a wellbore, a typical cased, cemented hole. FIG. *6b* shows an uncased, uncemented open hole.

FIGS. 7–10 depict in cross-section a variety of entry tools according to the present invention.

Figure 11:
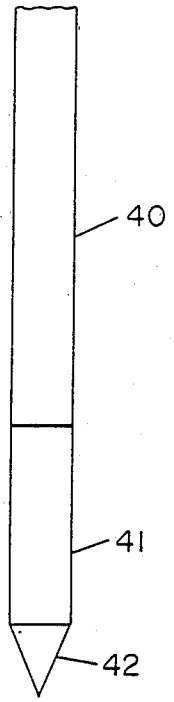

FIG. 11 shows a pointed entry tool connected to a tubular string for introducing the string into a mass of smooth-surfaced particles in a wellbore, in cross-section.

Figure 12:
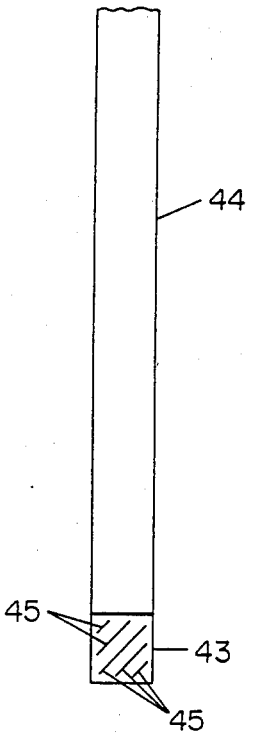

FIG. 12 is like FIG. 11 but shows a non-pointed entry tool having auger plates thereon.

Figure 13:
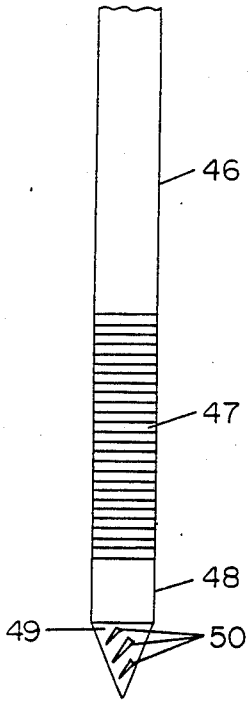

FIG. 13 is like FIG. 12 but shows the entry tool disposed below a sand control filter screen, and the entry tool has auger wedges.

Figure 14:
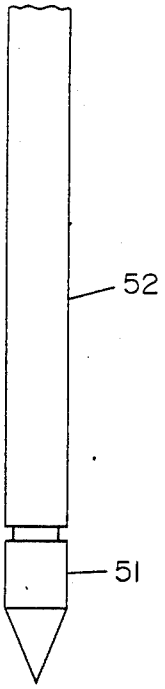

FIG. 14 is a cross-sectional view of a tubular string and entry tool according to the present invention, the entry tool rotatably connected to the tubular string.

Figure 15:
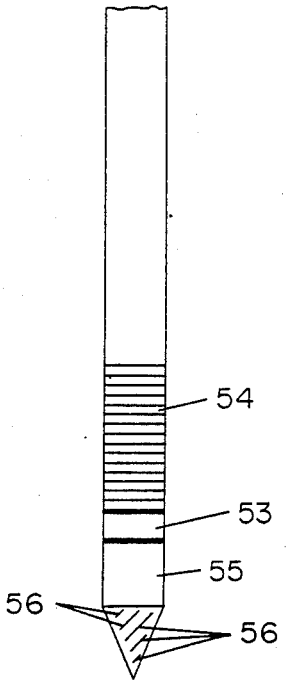

FIG. 15 is a cross-sectional view of another tubular string and entry tool according to the present invention, the entry tool connected to a swivel element which is in turn connected to a screen filter.

Figures 16A, 16B, 16C:
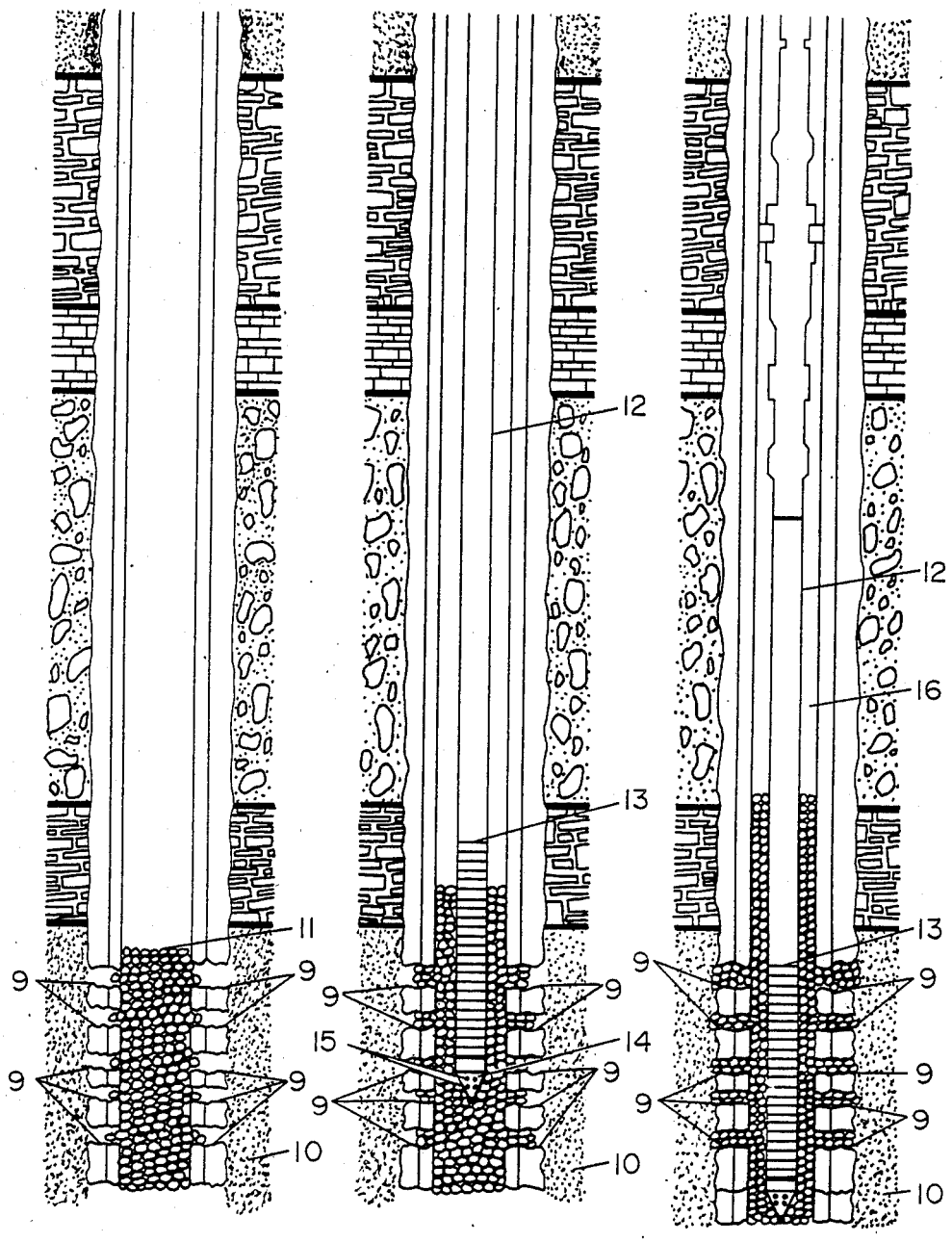

FIGS. 16*a, b, c* depict in cross-section one embodiment of the method and apparatus of the present invention; FIG. 16*a* shows a cased hole with an amount of smooth-surfaced particles deposited in it; FIG. 16*b* shows the same hole with a production string having an entry tool and screen filter connected to it entering the particle mass; FIG. 16*c* shows the production string stationary in the hole with its end and screen filter covered by the particles.

Figures 17A, 17B, 17C:
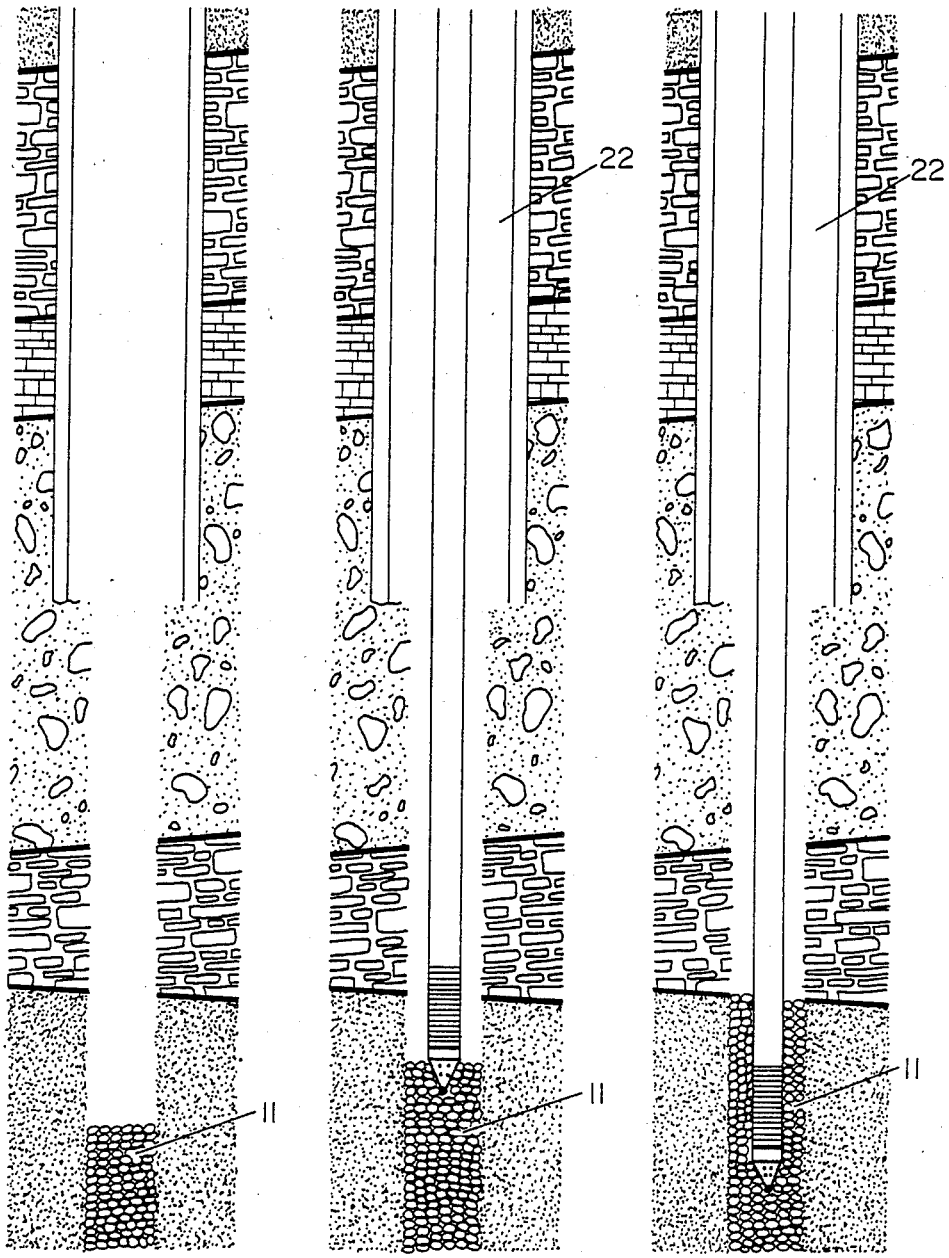

FIGS. 17*a, b, c* show another embodiment in cross-section; FIG. 17*a* shows an open hole with an amount of smooth-surfaced particles deposited therein; FIG. 17*b* shows a tubular string being introduced into the hole and into the particles; FIG. 17 shows the string stationary in the hole.

DESCRIPTION OF PREFERRED EMBODIMENTS

Figure 1:
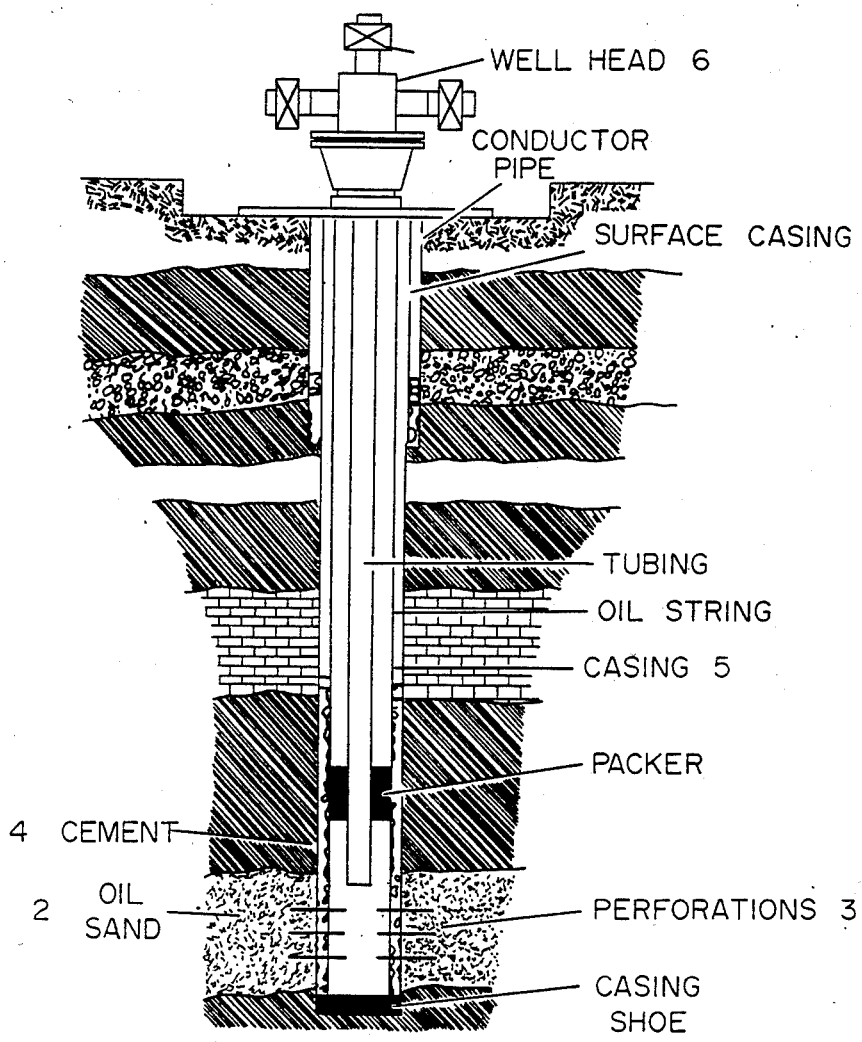
PRIOR ART FIGURE 1
FIG. 1 is an illustrative schematic view showing a typical production string emplaced in a cased and perforated wellbore, in cross-section.

FIG. 1 illustrates a typical well production configuration. The fluids to be produced are in the oil sand 2. The perforations 3 extend through the cement 4 and the casing 5 to permit the fluids to be produced to flow from the oil sand 2 up the casing 5 to the well head 6.

Figure 2:
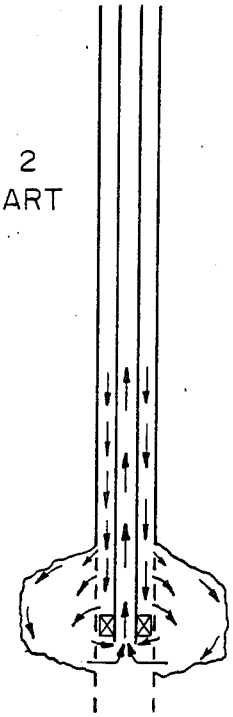
FIGURE 2 PRIOR ART
FIGS. 2–5 depict a conventional wash down gravel pack system for sand control, in cross-section.
Figure 3:
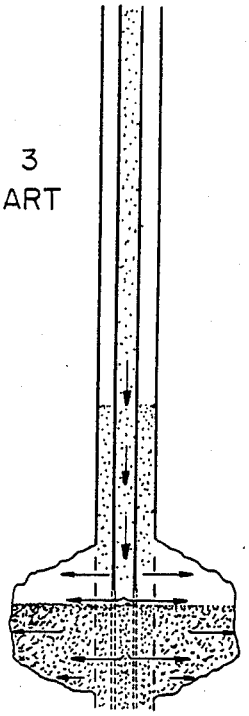
FIGURE 3 PRIOR ART
Figure 4:
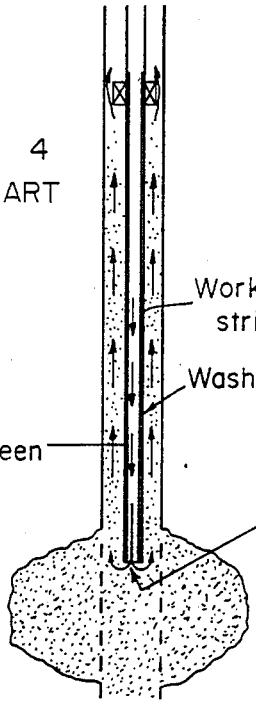
FIGURE 4 PRIOR ART
Figure 5:
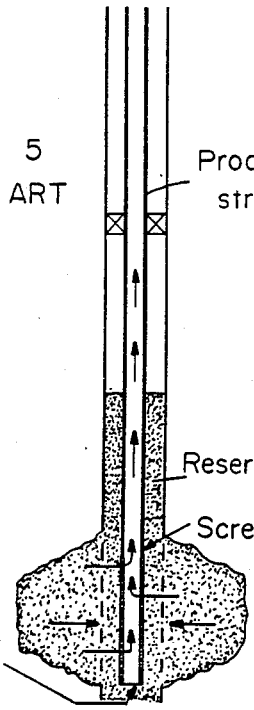
FIGURE 5 PRIOR ART

FIGS. 2 through 5 illustrate typical wash down gravel pack system and devices. In FIG. 2 the area around the production formation and perforations is washed by a suitable fluid pumped down the casing. As shown in FIG. 3 gravel for packing is pumped down the casing and through the perforations. In FIG. 4 a working string with a screen filter has been introduced into the gravel pack. Fluid pumped down the interior wash pipe helps the string descend through the gravel pack. As shown in FIG. 5 the working string has been removed and a production string is in place.

Figure 6A:
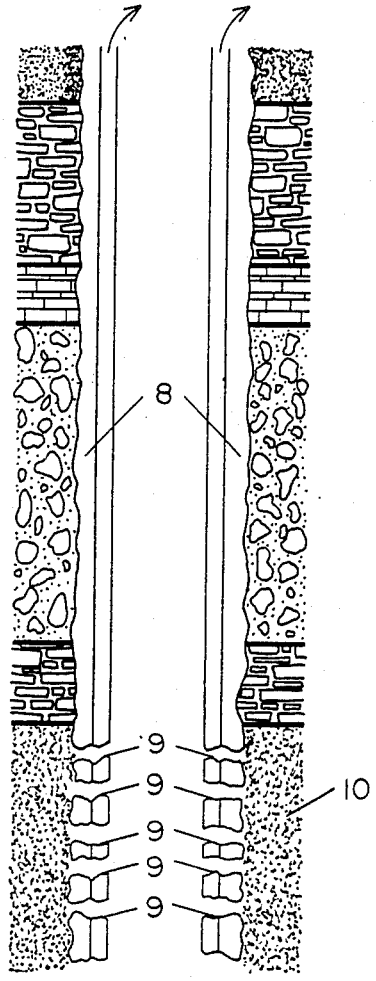
FIGURE 6a PRIOR ART
Figure 6B:
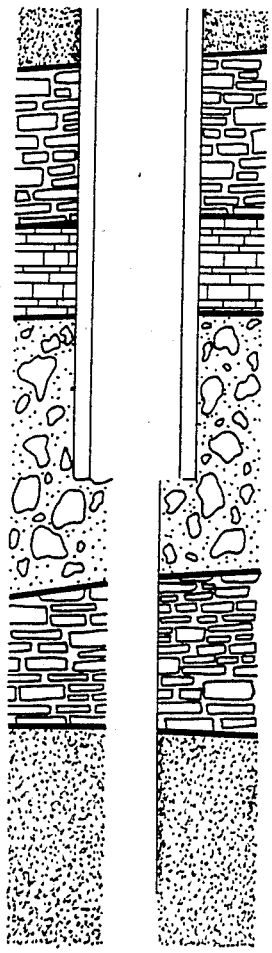
FIGURE 6b PRIOR ART
Figure 7:
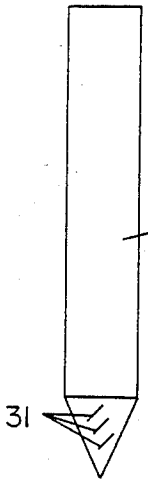
Figure 8:
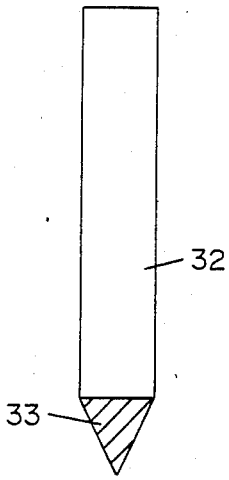
Figure 9:
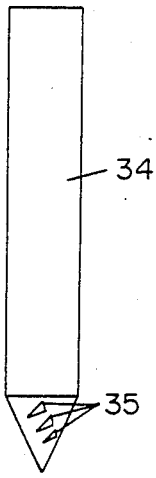

FIG. 6*a* shows a typical cased, cemented hole. The casing 7 is surrounded bythe cement 8. The perforations 9 extend through the casing 7 and the cement 8 into the producing formation 10. FIG. 6*b* shows an uncased, uncemented open hole.

One embodiment of the method according to the present invention is illustrated in FIGS. 16*a, b, c* (not to scale). As shown in FIG. 16*a* an amount 11 of smooth-surfaced particles has been poured into the cased hole. Some of the particles 11 have gone into the perforations 9. Any smooth-surfaced particles which are non-frangible under normal operating conditions may be used. The preferred shape is perfectly spherical. The preferred material is glass. Spherical glass beads of 20/40 U.S. Mesh have worked well. The particle size used will depend on many factors including the size of the formation sand particles. It is believed that particles in sizes from 4 to 60 U.S. Mesh may be used satisfactorily, with particles in the 6 to 25 U.S. Mesh sizes preferred.

As shown in FIG. 16*b* the production string 12 with the screen filter and the entry tool 14 have entered the amount of particles 11, forcing some up the hole and some further into the perforations 9. The entry tool 14 may be a conventional pointed jet shoe with ports 15 for exhausting pumped fluid. FIG. 16*c* shows the string 12 descended to the bottom of the hole and the particles 11 filling the perforations 9 and extending into the formation 10. The particles 11 serve to prevent formation sands from entering the annulus 16 and to filler fluids produced from the formation 10 before they are brought to the surface.

FIGS. 17*a, b, c* (not to scale) show another embodiment of the system, method and apparatus according to the present invention. The open hole of FIG. 17*a* has had an amount 21 of particles 11 deposited in it. As shown in FIG. 17*b* the tubular string 22 with the screen 23 and the jet shoe 24 attached has been introduced into the hole and into the particles 11. The level of the particles has risen. As shown in FIG. 17*c* the tubular string is stationary and the particles cover the screen 23.

Figure 10:
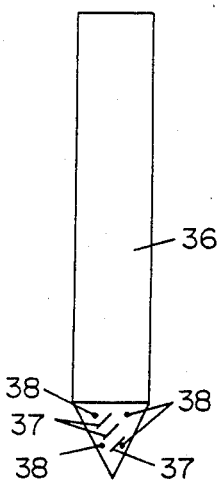

FIGS. 7–15 illustrate various embodiments of entry tools according to the present invention. Each of the tools in FIGS. 7–10, 12, 13 and 15 has a different type of auger mechanism. The term "auger" is intended to include any device which provides a screw, wedge, auger or thread function to assist the string in moving through the particles. Each of the tools of FIGS. 7–11 and 13–15 is pointed to further assist in the string's movement. As shown in FIB. 12 the tool need not be pointed and may be flat. The tool 30 of FIG. 7 has a plurality of inclined plates 31 affixed thereto or formed integrally thereof to assist in moving the tool through the particles. The tool 32 of FIG. 8 has the threads 33 for the same purpose and the tool 34 of FIG. 9 has the plane wedges 35. The tool 36 of FIG. 10 is a conventional jet shoe to which the inclined plates 37 have been affixed. The shoe 36 has the ports 38 to permit fluid to flow out of the shoe 36 under pressure.

FIG. 11 depicts the tubular string 40 to which is connected the entry tool 41 which has a pointed end 42 for facilitating the movement of the tool and string into a mass of particles deposited in a wellbore. The entry tool 43 is connected to the tubular string 44. The tool 43 has a plurality of inclined plates 45 affixed thereto to facilitate in the movement of the particles and of the tool 43 and the string 44. Each of the auger mechanisms described herein also aids in moving the smooth-surfaced particles as well as in facilitating the movement of a tubular or production string through the particles. FIG. 13 shows the tubular string 46 to which is connected the sand control screen filter 47 and the entry tool 48. The tool 48 has the pointed end 49 and the auger wedges 50 affixed thereto.

FIG. 14 illustrates the rotatable connection of the entry tool 51 to the tubular string 52.

FIG. 15 illustrates the use of a swivel. The swivel 53 is swivelly connected both to the screen filter 54 and to the entry tool 55. The entry tool 55 has a plurality of inclined plates 56 affixed thereto or formed integrally thereof.

What is claimed is:

1. A method for controlling sands in a wellbore, the method comprising the steps of introducing an amount of particles into the wellbore, introducing a tubular string into the particles and moving the string downwardly in the particles, the tubular string having swivel means for rotatably connecting an entry tool to the string, the swivel means connected between the string and the entry tool, the swivel means having a diameter no greater than the diameter of the string, the entry tool mounted to the swivel means for relative rotation therewith, the tool having auger means thereon for facilitating the introduction of the string into the particles.

2. The method of claim 1 wherein the string is a production string having sand control filter means mounted at or near its bottom, the swivel means is disposed beneath the filter means and the entry tool is disposed beneath the swivel means.

3. The method of claim 1 in which the entry tool has a point for facilitating the introduction of the string into the particles.

4. A tool for facilitating the introduction of a tubular string into an accumulation of particles in a wellbore having perforations for production, the tool comprising body means, rotative connection means for rotatably connecting the body means to the string for relative rotation therewith, the rotative connection means connected between the string and the body means and having a diameter no greater than the diameter of the string, and auger means connected to the body means for augering into the particles and for facilitating the movement of particles into the perforations.

5. The tool of claim 4 having a pointed end for facilitating the introduction of the tool and string into the particles.

6. The tool of claim 4 wherein a sand control filter is provided connected to the string and the rotative connection means is rotatably connected to and below the sand control filter for rotation of the entry tool relative to the string and to the sand control filter.

* * * * *